US009809873B2

(12) United States Patent
Sugahara

(10) Patent No.: US 9,809,873 B2
(45) Date of Patent: Nov. 7, 2017

(54) NI-BASED ALLOY HAVING EXCELLENT HOT FORGEABILITY AND CORROSION RESISTANCE, AND LARGE STRUCTURAL MEMBER

(71) Applicants: Hitachi Metals MMC Superalloy, LTD., Saitama (JP); Hitachi Metals, LTD., Tokyo (JP)

(72) Inventor: Katsuo Sugahara, Saitama (JP)

(73) Assignee: Hitachi Metals MMC Superalloy, Ltd., Saitama (JP)

( * ) Notice: Subject to any disclaimer, the term of this patent is extended or adjusted under 35 U.S.C. 154(b) by 0 days.

(21) Appl. No.: 15/110,997

(22) PCT Filed: Jul. 14, 2014

(86) PCT No.: PCT/JP2014/068741

§ 371 (c)(1),
(2) Date: Jul. 12, 2016

(87) PCT Pub. No.: WO2015/129063

PCT Pub. Date: Sep. 3, 2015

(65) Prior Publication Data

US 2016/0333444 A1 Nov. 17, 2016

(30) Foreign Application Priority Data

Feb. 26, 2014 (JP) ..... 2014-035267

(51) Int. Cl.
*C22C 19/05* (2006.01)

(52) U.S. Cl.
CPC ..... *C22C 19/056* (2013.01); *C22C 19/05* (2013.01); *C22C 19/055* (2013.01)

(58) Field of Classification Search
CPC ..... C22C 19/055; C22C 19/056
See application file for complete search history.

(56) References Cited

U.S. PATENT DOCUMENTS 5,529,642 A * 6/1996 Sugahara ..... C22C 19/053 148/427

FOREIGN PATENT DOCUMENTS

| | | |
|---|---|---|
| JP | 2910565 | 6/1994 |
| JP | 07-316697 | 5/1995 |
| JP | 08-003666 | 9/1996 |
| JP | 08-003670 | 9/1996 |

OTHER PUBLICATIONS

Choudhury, I. A., and M. A. El-Baradie. "Machinability of nickel-base super alloys: a general review." Journal of Materials Processing Technology 77.1 (1998): 278-284.*
International Search Report for PCT/JP2014/068741, Japanese Patent Office, dated Sep. 9, 2014.

* cited by examiner

*Primary Examiner* — Jessee Roe
(74) *Attorney, Agent, or Firm* — Williams Mullen, PC; F. Michael Sajovec

(57) ABSTRACT

A Ni-based alloy having excellent hot forgeability and corrosion resistance includes, by mass %, Cr: more than 18% to less than 21%, Mo: more than 18% to less than 21%, Ta: 1.1% to 2.5%, Mg: 0.001% to 0.05%, N: 0.001% to 0.04%, Mn: 0.001% to 0.5%, Si: 0.001% to 0.05%, Fe: 0.01% to 1%, Co: 0.01% or more and less than 1%, Al: 0.01% to 0.5%, Ti: 0.01% or more and less than 0.1%, V: 0.005% or more and less than 0.1%, Nb: 0.001% or more and less than 0.1%, B: 0.0001% to 0.01%, Zr: 0.001% to 0.05%, and a balance consisting of Ni and unavoidable impurities.

8 Claims, 1 Drawing Sheet

NI-BASED ALLOY HAVING EXCELLENT HOT FORGEABILITY AND CORROSION RESISTANCE, AND LARGE STRUCTURAL MEMBER

RELATED APPLICATION

Priority is claimed to Japanese Patent Application No. 2014-035267, filed Feb. 26, 2014, the disclosure of which is incorporated herein by reference.

TECHNICAL FIELD

The present invention relates to a Ni-based alloy having excellent hot forgeability and corrosion resistance used in a portion which requires to have corrosion resistance against corrosion due to acid in towers, tanks, and pipes associated with petrochemical and chemical industries, a pollution control system, a salt-making apparatus, a semiconductor-manufacturing apparatus, a pharmaceutical-manufacturing apparatus, and the like, and which is particularly suitable for forming a large structural member in which a weld zone is reduced.

BACKGROUND ART

In the related art, for a structural member having excellent corrosion resistance, particularly having excellent corrosion resistance against sulfuric acid, and requiring hot workability, for example, as disclosed in PTL 1, it is known that a Ni-based alloy is used including, as a composition, by mass %, Cr: 16% to 27%, Mo: 16% to 25% (however, Cr+Mo≤44%), Ta: 1.1% to 3.5%, Fe:0.01% to 6%, Mn: 0.0001% to 3%, Si: 0.0001% to 0.3%, C: 0.001% to 0.1%, Mg: 0.0001% to 0.3%, further, as necessary, one or more of (a) at least one of B: 0.001% to 0.01%, Zr: 0.001% to 0.01%, and Ca:0.001% to 0.01%, (b) at least one of Nb: 0.1% to 0.5%, W: 0.1% to 2%, and Cu: 0.1% to 2%, (c) at least one of Ti: 0.05% to 0.8%, and Al: 0.01% to 0.8%, (d) at least one of Co: 0.1% to 5%, and V: 0.1% to 0.5%, and (e) Hf: 0.1% to 2%, and a balance consisting of Ni and unavoidable impurities.

In addition, as a Ni-based alloy having excellent hot workability and corrosion resistance under an environment that includes chlorine ions, for example, as shown in PTL 2, it is known that a Ni-based alloy is used including, as a composition, by mass %, Cr: 15% to 35%, Mo: 6% to 24% (however, Cr+Mo≤43%), Ta: 1.1% to 8%, Mn: 0.0001% to 3%, Si: 0.0001% to 0.3%, C: 0.001% to 0.1%, N: 0.0001% to 0.1%, and a balance consisting of Ni and unavoidable impurities.

SUMMARY OF INVENTION

Technical Problem

A technique applicable to equipment recently used in a petrochemical plant, a pharmaceutical intermediate-manufacturing plant, and a pollution control system has become sophisticated and the size of the apparatuses has increased along with increases in the volume of production and processing. Accordingly, by reducing a weld zone as much as possible, there has been an increasing demand for minimizing a portion having deteriorated corrosion resistance.

That is, such a demand can be met when an increase in the size of a Ni-based corrosion-resistant alloy member applied to the above-described equipment is realized. However, in order to increase the size of the member, a large cast ingot is subjected to homogenizing heat treatment and then subjected to hot forging to form a Ni-based corrosion-resistant alloy member. Therefore, it is required that the Ni-based alloy have excellent hot forgeability.

For example, while the deformation resistance of the conventional Ni-based alloy disclosed in PTL 1 is reduced at a high temperature, the deformability is rapidly deteriorated at a temperature higher than a specific temperature. Therefore, the hot forging temperature is set to be at a temperature region near 1180° C. When hot forging is performed under the condition of a temperature higher than the above temperature, the deformation resistance of the Ni-based alloy is decreased and thus a Ni-based alloy can be easily deformed even at a relatively low forging pressure. However, when an attempt is made to increase the deformation amount by a single forging operation, the Ni-based alloy becomes easy to be cracked due to the lower deformability thereof.

When the deformation amount is smaller in the single forging operation, it becomes difficult to fracture the solidification structure and homogenize the structure. Thus, even when the hot forging temperature is lowered, a temperature region in which the deformability is high has to be selected. Therefore, when attempting to forge a large ingot, the shape is limited according to the capacity of a forging press machine. As a result, the size of the ingot is limited.

When the deformation amount is increased at the time of hot forging, the temperature is increased due to deformation heating and the temperature may reach a range in which the deformability is rapidly deteriorated. Thus, there is a limitation to set a temperature lower than the temperature by about 20° C. as an upper limit of forging temperature, or the like.

Needless to say, when the amounts of Cr, Mo, and Ta that are main alloy elements are reduced, the hot forgeability is also improved and the size can be increased. However, in this method, the corrosion resistance is significantly deteriorated.

There is a demand for a Ni-based alloy capable of forming a large member, having corrosion resistance equal to or higher than that of a conventional material, and improving hot forgeability (a temperature at which the deformability is rapidly deteriorated is shifted to a high-temperature side, thereby lowering the deformation resistance and preventing the deformability from deteriorating).

In consideration of such circumstances, in equipment members or the like manufactured using the conventional Ni-based alloys disclosed in PTLs 1 and 2 and used in a chemical plant or a pollution control system, there has been room for improvement on a request to reduce the number or the length of welding lines with an increase in the size of the above members.

Solution to Problem

Here, the present inventors conducted a study to solve the above problems and to produce a Ni-based alloy having further excellent hot forgeability and corrosion resistance than those of a conventional alloy. As a result, the present inventors have found that a Ni-based alloy including, by mass %, Cr: more than 18% to less than 21%, Mo: more than 18% to less than 21%, Ta: 1.1% to 2.5%, Mg: 0.001% to 0.05%, N: 0.001% to 0.04%, Mn: 0.001% to 0.5%, Si: 0.001 to 0.05, Fe: 0.01% to 1%, Co: 0.01% or more and less than 1%, Al: 0.01% to 0.5%, Ti: 0.01% or more and less than 0.1%, V: 0.005% or more and less than 0.1%, Nb: 0.001% or more and less than 0.1%, B: 0.0001% to 0.01%, Zr: 0.001% to 0.05%, and further, as necessary, one or more of (a) at least one of Cu: 0.001% or more and less than 0.1%, and W: 0.001% or more and less than 0.1%, (b) Ca: 0.001% or more and less than 0.05%, (c) Hf: 0.001% or more and less than 0.05%, and a balance consisting of Ni and unavoidable impurities, has both excellent hot forgeability and corrosion resistance.

The present invention has been made based on the above-described findings and is as follows.

(1) A Ni-based alloy having excellent hot forgeability and corrosion resistance including, by mass %, Cr: more than 18% to less than 21%,
Mo: more than 18% to less than 21%,
Ta: 1.1% to 2.5%,
Mg: 0.001% to 0.05%,
N: 0.001% to 0.04%,
Mn: 0.001% to 0.5%,
Si: 0.001% to 0.05%,
Fe: 0.01% to 1%,
Co: 0.01% or more and less than 1%,
Al: 0.01% to 0.5%,
Ti: 0.01% or more and less than 0.1%,
V: 0.005% or more and less than 0.1%,
Nb: 0.001% or more and less than 0.1%,
B: 0.0001% to 0.01%,
Zr: 0.001% to 0.05%, and
a balance consisting of Ni and unavoidable impurities.

(2) The Ni-based alloy having excellent hot forgeability and corrosion resistance according to (1) further including, by mass %, one or more of Cu: 0.001% or more and less than 0.1%, and
W: 0.001% or more and less than 0.1%.

(3) The Ni-based alloy having excellent hot forgeability and corrosion resistance according to (1) or (2) further including, by mass %, Ca: 0.001% or more and less than 0.05%.

(4) The Ni-based alloy having excellent hot forgeability and corrosion resistance according to any one of (1) to (3) further including, by mass %, Hf: 0.001% or more and less than 0.05%.

(5) A large structural member formed by the Ni-based alloy having excellent hot forgeability and corrosion resistance according to any one of (1) to (4).

Advantageous Effects of Invention

As described above, the Ni-based alloy according to the present invention has corrosion resistance equal to or higher than that of a conventional material and also has excellent hot forgeability. Therefore, when the Ni-based alloy according to the present invention is used, a large structural member, for example, a long seamless tube having a large diameter can be produced. In addition, due to an increase in the size of such a structural member, a weld zone can be reduced as much as possible and thus a portion having deteriorated corrosion resistance can be minimized.

Accordingly, according to the Ni-based alloy according to the present invention, it is possible to improve the corrosion resistance of the equipment as a whole used in a petrochemical plant, a pharmaceutical intermediate-manufacturing plant, and a pollution control system and to reduce the frequency of maintenance. In this manner, the Ni-based alloy according to the present invention exhibits excellent industrial effects.

DESCRIPTION OF EMBODIMENTS

Figure 1:
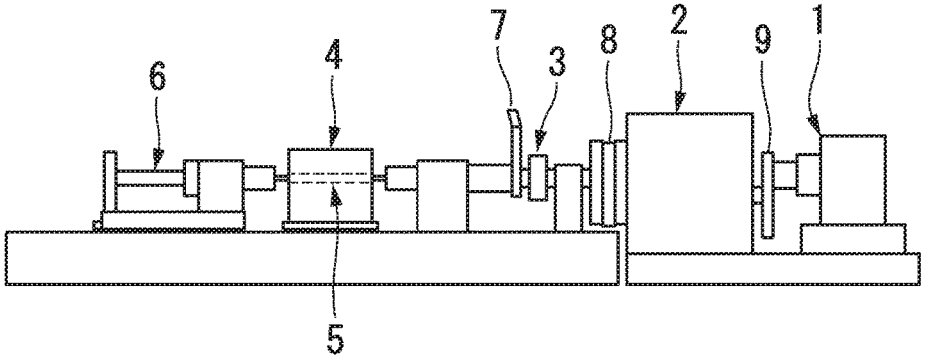
FIG. 1 is a schematic view showing an external appearance of a hot torsion test apparatus in Examples.

Next, a composition range of each component element of a Ni-based alloy according to an embodiment of the present invention and reasons for limiting the range will be described.

Cr and Mo:

Cr and Mo have an effect of improving corrosion resistance against acid such as hydrochloric acid and sulfuric acid. Particularly, in a petrochemical plant operated under a high-temperature environment, an acid having a relatively low concentration is used in many cases. The corrosion resistance against an acid having a relatively low concentration is exhibited by a Cr type passivation film containing Mo, and thus when Cr and Mo are combined and simultaneously contained, the effect of Cr and Mo is exhibited. In this case, it is necessary to contain more than 18 mass % of Cr (hereinafter, the "mass %" will be simply written as "%"). When the Cr content is 21% or more, in combination with Mo, the deformation resistance in a high-temperature region is rapidly increased and thus the hot forgeability is deteriorated. Therefore, the amount of Cr is set to more than 18% to less than 21%. The amount of Cr is preferably 18.5% to 20.5%. In the same manner, it is necessary to contain more than 18% of Mo. When the amount of Mo is 21% or more, in combination with Cr, the deformability in a high-temperature region is rapidly deteriorated and thus the hot forgeability is deteriorated. Therefore, the amount of Mo is set to more than 18% to less than 21%. The amount of Mo is preferably 18.5% to 20.5%.

Ta:

Ta has an effect of significantly strengthening and improving a passivation film by addition of a small amount of Ta. When the amount of Ta is 1.1% or more, an effect of significantly improving corrosion resistance against acid can be exhibited. When the amount of Ta is more than 2.5%, the deformability in a high-temperature region is rapidly deteriorated and thus the hot forgeability is deteriorated. Therefore, the amount of Ta is set to 1.1% to 2.5%. The amount of Ta is preferably 1.5% to 2.2%.

N, Mn, and Mg:

By coexistence of N, Mn, and Mg, the formation of a coarse μ phase ($Ni_7Mo_6$ type) which deteriorates hot forgeability at 1000° C. or lower can be suppressed. That is, N, Mn, and Mg stabilize a Ni-fcc phase which is a matrix and promotes the formation of a solid solution of Cr, Mo, and Ta. Thus, an effect of not easily precipitating the μ phase is obtained. Due to the effect, even in a temperature region lower than 1000° C., good hot forgeability can be maintained without causing a rapid increase in deformation resistance and a rapid deterioration in deformability.

When the amount of N is less than 0.001%, an effect of suppressing the formation of the μ phase cannot be obtained. Accordingly, in this case, the μ phase is excessively formed in a hot forging step at 1000° C. or lower and as a result, the hot forgeability is deteriorated. On the other hand, when the amount of N is more than 0.04%, nitrides are formed and workability at a high temperature is deteriorated, and thus, it is difficult to work the alloy into a large structural member. Therefore, the amount of N is set to 0.001% to 0.04%. The amount of N is preferably 0.005% to 0.03%.

In the same manner, when the amount of Mn is less than 0.001%, an effect of suppressing the formation of the μ phase cannot be obtained and accordingly, the hot forgeability at 1000° C. or lower is deteriorated. On the other hand, when the amount of Mn is more than 0.5%, the effect of suppressing the formation of the μ phase cannot be obtained and the corrosion resistance is deteriorated. Therefore, the amount of Mn is set to 0.001% to 0.5%. The amount of Mn is preferably 0.005% to 0.1%.

Similarly, when the amount of Mg is 0.001% or less, an effect of suppressing the formation of the μ phase cannot be obtained and accordingly, the hot forgeability at 1000° C. or lower is deteriorated. On the other hand, when the amount of Mg is more than 0.05%, the effect of suppressing the formation of the μ phase cannot be obtained and the corrosion resistance is deteriorated. Therefore, the amount of Mg is set to 0.001% to 0.05%. The amount of Mg is preferably 0.005% to 0.04%.

The effects of these three elements are not equivalent respectively and when the three elements are not simultaneously contained within a predetermined range, a sufficient effect cannot be obtained.

Si:

By adding Si as a deoxidizing agent, Si has an effect of reducing oxides and thereby improving the deformability at a high temperature relating to hot forgeability. The effect is exhibited by including 0.001% or more of Si. Including more than 0.05% of Si causes Si to be concentrated at boundaries, and thereby the deformability relating to the hot forgeability is rapidly deteriorated. Therefore, the amount of Si is set to 0.001% to 0.05%. The amount of Si is preferably 0.005% to 0.03%.

Fe and Co:

Fe and Co have an effect of preventing cracks by improving the toughness at a temperature of 1200° C. or higher. The effect is exhibited by including 0.01% or more of Fe. When the amount of Fe is more than 1%, the corrosion resistance is decreased. Therefore, the amount of Fe is set to 0.01% to 1%. The amount of Fe is preferably 0.1% to less than 1%.

In the same manner, the above-described effect is exhibited by including 0.01% or more of Co. When the amount of Co is 1% or more, the deformation resistance at a high-temperature region is increased. Therefore, the amount of Co is set to 0.01% or more and less than 1%. The amount of Co is preferably 0.1% to less than 1%.

Al and Ti:

Al and Ti have an effect of improving the deformability at a high temperature relating to hot forgeability.

The effect is exhibited by including 0.01% or more of Al. When the amount of Al is more than 0.5%, the deformation resistance is increased. Therefore, the amount of Al is set to 0.01% to 0.5%. The amount of Al is preferably 0.1% to 0.4%.

In the same manner, the above-described effect is exhibited by including 0.01% or more of Ti. When the amount of Ti is 0.1% or more, the deformation resistance is increased. Therefore, the amount of Ti is set to 0.01% or more and less than 0.1%. The amount of Ti is preferably 0.03% to less than 0.09%.

V and Nb:

V and Nb have an effect of suppressing coarsening of grains in a high-temperature region. Due to the effect, the deformability relating to the hot forgeability particularly at 1200° C. or higher is remarkably improved. The effect is exhibited by including 0.005% or more of V. When the amount of V is 0.1% or more, the deformability is rather deteriorated. Therefore, the amount of V is set to 0.005% or more and less than 0.1%. The amount of V is preferably 0.01% to 0.09%.

In the same manner, the above-described effect is exhibited by including 0.001% or more of Nb. When the amount of Nb is 0.1% or more, the corrosion resistance is deteriorated. Therefore, the amount of Nb is set to 0.001% or more and less than 0.1%. The amount of Nb is preferably 0.005% to 0.09%.

Zr and B:

Zr and B have an effect of improving the deformability in hot forgeability in a temperature region of 1200° C. or higher. The effect is exhibited by including 0.0001% or more of B. When the amount of B is more than 0.01%, the deformability is rather deteriorated. Therefore, the amount of B is set to 0.0001% to 0.01%. The amount of B is preferably 0.0005% to 0.005%.

In the same manner, the above-described effect is exhibited by including 0.001% or more of Zr. When the amount of Zr is more than 0.05%, the deformability is rather deteriorated. Therefore, the amount of Zr is set to 0.001% to 0.05%. The amount of Zr is preferably 0.005% to 0.03%.

Cu and W:

Cu and W have an effect of improving the corrosion resistance in a corrosive environment using sulfuric acid and hydrochloric acid and thus are added as necessary. The effect is exhibited by including 0.001% or more of Cu. When the amount of Cu is 0.1% or more, the hot forgeability tends to be deteriorated. Therefore, the amount of Cu is set to 0.001% or more and less than 0.1%. The amount of Cu is preferably 0.005% to 0.09%.

In the same manner, the above-described effect is exhibited by including 0.001% or more of W. When the amount of W is 0.1% or more, the hot forgeability tends to be deteriorated. Therefore, the amount of W is set to 0.001% or more and less than 0.1%. The amount of W is preferably 0.005% to 0.09%.

Ca:

Ca has an effect of improving the deformability in hot forgeability in a temperature region of 1200° C. or higher and thus is added as necessary. The effect is exhibited by including 0.001% or more of Ca. When the amount of Ca is 0.05% or more, the deformability is rather deteriorated. Therefore, the amount of Ca is set to 0.001% or more and less than 0.05%. The amount of Ca is preferably 0.005% to 0.01%.

Hf:

Hf has an effect of decreasing the deformation resistance in hot forgeability at a temperature region of 1200° C. or higher and thus is added as necessary. The effect is exhibited by including 0.001% or more of Hf. When the amount of Hf is 0.05% or more, the deformability tends to be deteriorated. Therefore, the amount of Hf is set to 0.001% or more and less than 0.05%. The amount of Hf is preferably 0.002% to 0.01%.

Unavoidable Impurities:

P, S, Sn, Zn, Pb, and C are unavoidably contained as melting raw materials. When the amounts are P: less than 0.01%, S: less than 0.01%, Sn: less than 0.01%, Zn: less than 0.01%, Pb: less than 0.002%, and C: less than 0.01%, it is allowable to contain the above-described component elements within the above-described ranges because alloy properties are not deteriorated.

Hereinafter, examples of the present invention will be described.

EXAMPLES

Using a typical high-frequency melting furnace, a Ni-based alloy having a predetermined component composition was melted and about 3 kg of a rod-like ingot having a size of 30 mm×30 mm×400 mm was formed. The ingot was subjected to homogenizing heat treatment at 1230° C. for 10 hours and then water-quenched. Thus, Ni-based alloys 1 to 46 of the present invention shown in Tables 1 and 3, comparative Ni-based alloys 1 to 30 shown in Tables 5 and 7, and conventional Ni-based alloys 1 to 3 shown in Table 9 were prepared.

The conventional Ni-based alloys 1 and 2 shown in Table 9 correspond to the alloy disclosed in PTL 1 (Japanese Patent No. 2910565) and the conventional Ni-based alloy 3 corresponds to the alloy disclosed in PTL 2 (Japanese Unexamined Patent Application, First Publication No. H7-316697).

In Tables 1, 3, 5, 7, and 9, the "balance" in the column of "Ni" includes unavoidable impurities. In addition, in Tables 5 and 7, an asterisk is attached to a composition out of the range of the embodiment of the present invention.

Figure 2:
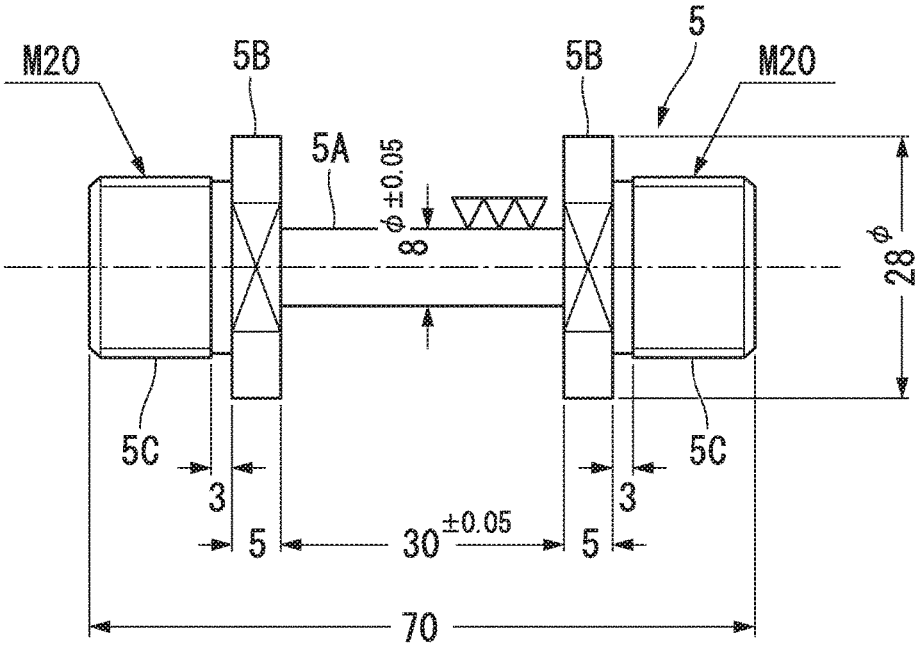
FIG. 2 is a view showing a size of a test piece for a hot torsion test in each Example.

From each of these rod-like ingots, a test piece 5 shown in FIG. 2 was prepared by machining and subjected to a hot torsion test and the maximum shear stress when the test piece was fractured and the number of torsions until the test piece was fractured were measured.

As shown in the external appearance of a hot torsion test apparatus in FIG. 1, the hot torsion test apparatus includes a motor 1, a gear box 2, a clutch 3, an electric furnace 4, a load cell 6, and a clutch lever 7 arranged on the same shaft. In addition, on both sides of the gear box 2, shaft protection covers 8 and 9 are provided. As the test piece 5, a smooth round bar type shown in FIG. 2 was used. Specifically, the test piece 5 includes a cylindrical parallel portion 5A, stopper portions 5B and 5B on both sides of the parallel portion 5A, and screw portions 5C and 5C on both sides of the stopper portion 5B. The test piece 5 is fixed to the hot torsion test apparatus by screwing the screw portions 5C and 5C with a test piece-fixing portion of a hot torsion test apparatus (not shown). At this time, the stopper portions 5B and 5B prevent gaps between the screw portions 5C and 5C and the test piece-fixing portion from generating during the hot torsion test. In the hot torsion test, the parallel portion 5A having a smaller diameter than the other portions is twisted. The test piece 5 was formed so that the parallel portion 5A had a diameter of 8 mm±0.05 mm and a length of 30 mm±0.05 mm, the stopper portions 5B had a maximum diameter of 28 mm and a width of 5 mm, the screw portions 5C had M20 threads, and the total length of the test piece 5 was 70 mm. In addition, non-screw portions of 3 mm were respectively provided between the screw portions 5C and the stopper portions 5B and also the surface of the parallel portion 5A was ground-finished.

The test piece 5 was mounted in the electric furnace 4 coaxially as the motor 1, the temperature inside the electric furnace 4 was increased to 1250° C., which was a test temperature, and then the rotation of the motor 1 was driven. After the rotation of the motor 1 was stabilized, the clutch 3 was connected so that the rotation of the motor 1 was transmitted to the test piece 5. A rotated end of the test piece 5 (right end in FIG. 1) was twisted at a torsion rate of 100 rpm by the rotation of the motor 1 to perform a both-ends restrain torsion test. At this time, a rotation load applied to a fixed end of the test piece 5 (left end in FIG. 1) was measured at the load cell 6. The maximum value of the measured rotation load was divided by a cross-sectional area of the parallel portion 5A of the test piece 5 to calculate a value of the maximum shear stress. Further, the number of rotations of the rotated end of the test piece 5 relative to the fixed end (a number proportional to the number of rotations of the motor 1) until the parallel portion 5A of the test piece 5 was fractured was measured as the number of torsions.

The maximum shear stress (MPa) (deformation resistance) and the number of torsions (times) (deformability) obtained as the results of the test are shown in Tables 2, 4, 6, 8, and 10.

Next, the corrosion resistance was evaluated by conducting a corrosion test using sulfuric acid and hydrochloric acid having a relatively low concentration.

Each of materials having a size of 30 mm×30 mm×100 mm was cut from each of square bars (rod-like ingots) having compositions in Tables 1, 3, 5, 7, and 9. While materials were maintained within a range of 900° C. to 1250° C., each of plates having a thickness of 5 mm was produced by hot forging submitted to each of materials (deformed from 30 mm to 5 mm by a single press operation).

Each of the plates having a thickness of 5 mm was maintained at 1180° C. for 30 minutes, water-quenched, and then cut into a plate piece having a size of 25 mm×25 mm×thickness 3 mm. Then, each surface of the plate pieces was polished and lastly finish-polished by waterproof 400 grit emery paper to prepare each corrosion test piece.

The finish-polished test pieces were kept in an ultrasonic vibration state in acetone for 5 minutes thereby degreasing the test pieces.

Each of the Ni-based alloys 1 to 46 of the present invention, comparative Ni-based alloys 1 to 20, and conventional alloys 1 to 3 was subjected to an immersion tests in a solution of 1% hydrochloric acid (1% HCl) and a solution of 10% sulfuric acid (10% $H_2SO_4$), which were maintained at a boiling temperature thereof, for 24 hours. A corrosion rate was calculated based on weight loss before and after the immersion test. Specifically, the corrosion rate was calculated by the following equation.

$$\text{Corrosion rate}(mm/\text{year}) = \Delta W/(S \cdot t) \times 8.761/\rho$$

ΔW: reduction amount of weight (g) before and after test

S: surface area of test piece ($m^2$)

t: Test time (h)

ρ: Specific gravity ($g/cm^3$)

The calculation results are shown in Tables 2, 4, 6, 8, and 10.

TABLE 1

(unit: mass %)

| Type | Cr | Mo | Ta | Mg | N | Mn | Si | Fe | Co | Al | Ti | V | Nb | B | Zr | Cu | W | Ca | Hf | Ni |
|---|---|---|---|---|---|---|---|---|---|---|---|---|---|---|---|---|---|---|---|---|
| 1 | 18.8 | 19.1 | 1.8 | 0.010 | 0.012 | 0.010 | 0.011 | 0.15 | 0.45 | 0.31 | 0.08 | 0.011 | 0.013 | 0.0010 | 0.010 | — | — | — | — | Balance |
| 2 | 18.1 | 20.5 | 1.5 | 0.022 | 0.005 | 0.034 | 0.028 | 0.10 | 0.25 | 0.12 | 0.05 | 0.023 | 0.006 | 0.0007 | 0.005 | — | — | — | — | Balance |
| 3 | 20.9 | 18.5 | 2.0 | 0.005 | 0.018 | 0.006 | 0.008 | 0.23 | 0.40 | 0.16 | 0.04 | 0.018 | 0.039 | 0.0014 | 0.012 | — | — | — | — | Balance |
| 4 | 19.5 | 18.1 | 2.2 | 0.038 | 0.027 | 0.045 | 0.016 | 0.27 | 0.39 | 0.39 | 0.07 | 0.045 | 0.045 | 0.0023 | 0.014 | — | — | — | — | Balance |
| 5 | 18.5 | 20.9 | 1.6 | 0.012 | 0.016 | 0.078 | 0.022 | 0.12 | 0.31 | 0.14 | 0.04 | 0.089 | 0.019 | 0.0048 | 0.016 | — | — | — | — | Balance |
| 6 | 19.6 | 20.5 | 1.1 | 0.008 | 0.008 | 0.027 | 0.021 | 0.15 | 0.55 | 0.20 | 0.06 | 0.076 | 0.025 | 0.0033 | 0.021 | — | — | — | — | Balance |
| 7 | 18.8 | 18.7 | 2.5 | 0.009 | 0.017 | 0.088 | 0.018 | 0.33 | 0.65 | 0.25 | 0.05 | 0.045 | 0.068 | 0.0019 | 0.026 | — | — | — | — | Balance |
| 8 | 19.4 | 19.1 | 1.7 | 0.001 | 0.013 | 0.067 | 0.014 | 0.39 | 0.14 | 0.19 | 0.04 | 0.033 | 0.087 | 0.0012 | 0.020 | — | — | — | — | Balance |

TABLE 1-continued (unit: mass %)

| Type | Cr | Mo | Ta | Mg | N | Mn | Si | Fe | Co | Al | Ti | V | Nb | B | Zr | Cu | W | Ca | Hf | Ni |
|---|---|---|---|---|---|---|---|---|---|---|---|---|---|---|---|---|---|---|---|---|
| 9 | 18.9 | 19.7 | 1.8 | 0.049 | 0.019 | 0.098 | 0.010 | 0.64 | 0.38 | 0.33 | 0.08 | 0.041 | 0.065 | 0.0045 | 0.019 | — | — | — | — | Balance |
| 10 | 20.1 | 18.5 | 2.0 | 0.031 | 0.002 | 0.076 | 0.012 | 0.22 | 0.75 | 0.30 | 0.04 | 0.019 | 0.019 | 0.0031 | 0.007 | — | — | — | — | Balance |
| 11 | 19.8 | 19.2 | 1.6 | 0.014 | 0.039 | 0.025 | 0.019 | 0.78 | 0.88 | 0.21 | 0.05 | 0.088 | 0.021 | 0.0024 | 0.011 | — | — | — | — | Balance |
| 12 | 19.3 | 19.4 | 1.7 | 0.011 | 0.023 | 0.001 | 0.012 | 0.45 | 0.73 | 0.21 | 0.03 | 0.067 | 0.027 | 0.0036 | 0.016 | — | — | — | — | Balance |
| 13 | 20.4 | 18.5 | 1.9 | 0.019 | 0.018 | 0.497 | 0.024 | 0.26 | 0.12 | 0.19 | 0.04 | 0.055 | 0.056 | 0.0058 | 0.014 | — | — | — | — | Balance |
| 14 | 19.8 | 18.6 | 2.1 | 0.020 | 0.022 | 0.057 | 0.002 | 0.31 | 0.16 | 0.11 | 0.05 | 0.041 | 0.048 | 0.0032 | 0.027 | — | — | — | — | Balance |
| 15 | 19.5 | 18.7 | 1.9 | 0.016 | 0.015 | 0.073 | 0.049 | 0.40 | 0.10 | 0.16 | 0.06 | 0.033 | 0.076 | 0.0026 | 0.019 | — | — | — | — | Balance |
| 16 | 19.1 | 19.7 | 1.6 | 0.014 | 0.011 | 0.094 | 0.017 | 0.01 | 0.22 | 0.24 | 0.06 | 0.037 | 0.034 | 0.0035 | 0.023 | — | — | — | — | Balance |
| 17 | 18.9 | 20.1 | 1.7 | 0.009 | 0.013 | 0.023 | 0.022 | 0.98 | 0.28 | 0.29 | 0.05 | 0.021 | 0.021 | 0.0041 | 0.017 | — | — | — | — | Balance |
| 18 | 19.0 | 19.5 | 1.5 | 0.029 | 0.018 | 0.032 | 0.029 | 0.36 | 0.02 | 0.33 | 0.04 | 0.018 | 0.016 | 0.0022 | 0.012 | — | — | — | — | Balance |
| 19 | 19.2 | 19.4 | 2.0 | 0.013 | 0.021 | 0.030 | 0.011 | 0.20 | 0.98 | 0.14 | 0.05 | 0.015 | 0.018 | 0.0030 | 0.018 | — | — | — | — | Balance |
| 20 | 18.7 | 19.3 | 2.1 | 0.014 | 0.014 | 0.065 | 0.017 | 0.29 | 0.37 | 0.01 | 0.06 | 0.014 | 0.043 | 0.0027 | 0.009 | — | — | — | — | Balance |
| 21 | 20.0 | 18.6 | 2.3 | 0.008 | 0.008 | 0.008 | 0.023 | 0.14 | 0.56 | 0.49 | 0.07 | 0.033 | 0.039 | 0.0017 | 0.010 | — | — | — | — | Balance |
| 22 | 19.7 | 18.8 | 1.9 | 0.015 | 0.009 | 0.044 | 0.027 | 0.66 | 0.31 | 0.22 | 0.01 | 0.049 | 0.048 | 0.0010 | 0.011 | — | — | — | — | Balance |
| 23 | 19.5 | 19.0 | 1.8 | 0.023 | 0.013 | 0.059 | 0.018 | 0.31 | 0.61 | 0.19 | 0.09 | 0.038 | 0.021 | 0.007 | 0.006 | — | — | — | — | Balance |

TABLE 2

| | Hot torsion test | | Corrosion test | | |
|---|---|---|---|---|---|
| Type | Maximum shear stress (MPa) | Number of torsions (times) | Boiling 1% HCl (mm/year) | Boiling 10% $H_2SO_4$ (mm/year) | State after forging in test piece-producing step |
| 1 | 80 | 9.2 | 0.008 | 0.036 | No cracks |
| 2 | 80 | 8.2 | 0.005 | 0.030 | No cracks |
| 3 | 87 | 8.4 | 0.006 | 0.032 | No cracks |
| 4 | 82 | 8.6 | 0.004 | 0.022 | No cracks |
| 5 | 78 | 6.1 | 0.010 | 0.041 | No cracks |
| 6 | 82 | 7.2 | 0.004 | 0.013 | No cracks |
| 7 | 78 | 6.4 | 0.010 | 0.040 | No cracks |
| 8 | 80 | 8.0 | 0.004 | 0.028 | No cracks |
| 9 | 79 | 8.5 | 0.006 | 0.032 | No cracks |
| 10 | 78 | 8.1 | 0.009 | 0.041 | No cracks |
| 11 | 79 | 7.8 | 0.009 | 0.038 | No cracks |
| 12 | 79 | 9.0 | 0.007 | 0.024 | No cracks |
| 13 | 80 | 8.4 | 0.004 | 0.028 | No cracks |
| 14 | 78 | 7.9 | 0.008 | 0.036 | No cracks |
| 15 | 79 | 6.2 | 0.008 | 0.037 | No cracks |
| 16 | 81 | 7.6 | 0.004 | 0.028 | No cracks |
| 17 | 77 | 9.1 | 0.010 | 0.040 | No cracks |
| 18 | 81 | 8.8 | 0.006 | 0.024 | No cracks |
| 19 | 81 | 7.4 | 0.004 | 0.023 | No cracks |
| 20 | 81 | 8.1 | 0.005 | 0.029 | No cracks |
| 21 | 79 | 7.9 | 0.007 | 0.034 | No cracks |
| 22 | 79 | 8.4 | 0.008 | 0.037 | No cracks |
| 23 | 80 | 8.5 | 0.009 | 0.041 | No cracks |

TABLE 3

| Type | Cr | Mo | Ta | Mg | N | Mn | Si | Fe | Co | Al | Ti | V | Nb |
|---|---|---|---|---|---|---|---|---|---|---|---|---|---|
| 24 | 19.2 | 19.2 | 1.8 | 0.016 | 0.008 | 0.064 | 0.011 | 0.18 | 0.21 | 0.12 | 0.03 | 0.005 | 0.016 |
| 25 | 18.9 | 19.6 | 1.5 | 0.011 | 0.013 | 0.077 | 0.007 | 0.12 | 0.37 | 0.25 | 0.06 | 0.097 | 0.023 |
| 26 | 19.4 | 19.0 | 2.0 | 0.008 | 0.017 | 0.083 | 0.027 | 0.22 | 0.31 | 0.34 | 0.05 | 0.081 | 0.001 |
| 27 | 19.3 | 19.1 | 1.8 | 0.013 | 0.011 | 0.043 | 0.030 | 0.25 | 0.43 | 0.15 | 0.05 | 0.051 | 0.098 |
| 28 | 19.2 | 19.3 | 2.1 | 0.022 | 0.010 | 0.079 | 0.028 | 0.31 | 0.48 | 0.28 | 0.04 | 0.055 | 0.054 |
| 29 | 18.7 | 19.7 | 1.9 | 0.026 | 0.019 | 0.038 | 0.022 | 0.20 | 0.36 | 0.31 | 0.05 | 0.023 | 0.074 |
| 30 | 19.0 | 19.5 | 1.8 | 0.014 | 0.022 | 0.081 | 0.025 | 0.12 | 0.56 | 0.38 | 0.07 | 0.037 | 0.013 |
| 31 | 19.8 | 18.7 | 1.7 | 0.016 | 0.025 | 0.043 | 0.018 | 0.59 | 0.62 | 0.27 | 0.06 | 0.031 | 0.054 |
| 32 | 19.6 | 18.9 | 2.2 | 0.007 | 0.019 | 0.059 | 0.013 | 0.51 | 0.46 | 0.12 | 0.05 | 0.018 | 0.040 |
| 33 | 19.8 | 18.6 | 1.8 | 0.009 | 0.023 | 0.065 | 0.015 | 0.46 | 0.21 | 0.16 | 0.06 | 0.015 | 0.021 |
| 34 | 19.2 | 19.4 | 1.6 | 0.013 | 0.014 | 0.011 | 0.021 | 0.33 | 0.36 | 0.18 | 0.07 | 0.011 | 0.011 |
| 35 | 19.4 | 18.9 | 1.7 | 0.019 | 0.018 | 0.021 | 0.023 | 0.28 | 0.31 | 0.22 | 0.05 | 0.020 | 0.017 |
| 36 | 19.3 | 19.0 | 1.9 | 0.020 | 0.015 | 0.031 | 0.016 | 0.19 | 0.27 | 0.31 | 0.08 | 0.026 | 0.024 |
| 37 | 19.1 | 19.4 | 1.7 | 0.013 | 0.013 | 0.048 | 0.005 | 0.39 | 0.48 | 0.39 | 0.06 | 0.036 | 0.033 |
| 38 | 19.2 | 19.7 | 1.6 | 0.018 | 0.011 | 0.036 | 0.013 | 0.35 | 0.55 | 0.24 | 0.03 | 0.038 | 0.038 |
| 39 | 18.9 | 19.6 | 1.7 | 0.017 | 0.012 | 0.027 | 0.017 | 0.27 | 0.51 | 0.13 | 0.04 | 0.046 | 0.041 |
| 40 | 18.8 | 19.9 | 1.9 | 0.011 | 0.015 | 0.056 | 0.022 | 0.62 | 0.43 | 0.18 | 0.04 | 0.044 | 0.036 |
| 41 | 19.0 | 19.7 | 1.8 | 0.014 | 0.016 | 0.044 | 0.020 | 0.36 | 0.38 | 0.14 | 0.05 | 0.057 | 0.022 |
| 42 | 19.4 | 19.1 | 1.6 | 0.016 | 0.021 | 0.030 | 0.025 | 0.51 | 0.31 | 0.27 | 0.03 | 0.039 | 0.028 |
| 43 | 18.6 | 20.0 | 1.6 | 0.009 | 0.027 | 0.061 | 0.018 | 0.49 | 0.48 | 0.21 | 0.05 | 0.014 | 0.025 |
| 44 | 18.7 | 19.7 | 1.7 | 0.010 | 0.020 | 0.134 | 0.014 | 0.45 | 0.41 | 0.38 | 0.06 | 0.017 | 0.034 |

TABLE 3-continued

| | | | | | | | | | | | | | |
|---|---|---|---|---|---|---|---|---|---|---|---|---|---|
| 45 | 18.9 | 19.9 | 1.5 | 0.011 | 0.007 | 0.036 | 0.017 | 0.27 | 0.37 | 0.30 | 0.07 | 0.041 | 0.048 |
| 46 | 19.2 | 19.4 | 1.6 | 0.014 | 0.014 | 0.087 | 0.011 | 0.35 | 0.22 | 0.23 | 0.04 | 0.060 | 0.067 |

(unit mass %)

| Type | B | Zr | Cu | W | Ca | Hf | Ni |
|---|---|---|---|---|---|---|---|
| 24 | 0.0022 | 0.007 | — | — | — | — | Balance |
| 25 | 0.0017 | 0.011 | — | — | — | — | Balance |
| 26 | 0.0039 | 0.014 | — | — | — | — | Balance |
| 27 | 0.0044 | 0.016 | — | — | — | — | Balance |
| 28 | 0.0002 | 0.014 | — | — | — | — | Balance |
| 29 | 0.0095 | 0.012 | — | — | — | — | Balance |
| 30 | 0.0016 | 0.001 | — | — | — | — | Balance |
| 31 | 0.0023 | 0.048 | — | — | — | — | Balance |
| 32 | 0.0038 | 0.012 | 0.001 | — | — | — | Balance |
| 33 | 0.0012 | 0.017 | 0.098 | — | — | — | Balance |
| 34 | 0.0044 | 0.016 | — | 0.001 | — | — | Balance |
| 35 | 0.0021 | 0.013 | — | 0.098 | — | — | Balance |
| 36 | 0.0013 | 0.012 | 0.012 | 0.022 | — | — | Balance |
| 37 | 0.0030 | 0.015 | — | — | 0.001 | — | Balance |
| 38 | 0.0028 | 0.023 | — | — | 0.048 | — | Balance |
| 39 | 0.0025 | 0.026 | 0.027 | 0.017 | 0.007 | — | Balance |
| 40 | 0.0014 | 0.022 | — | — | — | 0.001 | Balance |
| 41 | 0.0008 | 0.024 | — | — | — | 0.048 | Balance |
| 42 | 0.0020 | 0.012 | 0.034 | — | — | 0.008 | Balance |
| 43 | 0.0027 | 0.010 | — | 0.025 | — | 0.010 | Balance |
| 44 | 0.0032 | 0.008 | 0.014 | 0.019 | 0.009 | 0.006 | Balance |
| 45 | 0.0027 | 0.021 | 0.044 | — | 0.009 | — | Balance |
| 46 | 0.0041 | 0.017 | — | 0.038 | 0.007 | — | Balance |

TABLE 4

| | Hot torsion test | | Corrosion test | | |
|---|---|---|---|---|---|
| Type | Maximum shear stress (MPa) | Number of torsions (times) | Boiling 1% HCl (mm/year) | Boiling 10% $H_2SO_4$ (mm/year) | State after forging in test piece-producing step |
| 24 | 79 | 8.8 | 0.008 | 0.036 | No cracks |
| 25 | 78 | 6.2 | 0.010 | 0.044 | No cracks |
| 26 | 80 | 8.7 | 0.004 | 0.028 | No cracks |
| 27 | 79 | 6.1 | 0.008 | 0.037 | No cracks |
| 28 | 81 | 8.9 | 0.005 | 0.020 | No cracks |
| 29 | 81 | 6.2 | 0.004 | 0.026 | No cracks |
| 30 | 80 | 9.3 | 0.006 | 0.031 | No cracks |
| 31 | 77 | 6.4 | 0.010 | 0.044 | No cracks |
| 32 | 81 | 9.6 | 0.004 | 0.020 | No cracks |
| 33 | 78 | 6.1 | 0.009 | 0.041 | No cracks |
| 34 | 78 | 9.1 | 0.010 | 0.042 | No cracks |
| 35 | 77 | 6.3 | 0.010 | 0.044 | No cracks |
| 36 | 79 | 8.6 | 0.007 | 0.034 | No cracks |
| 37 | 79 | 9.2 | 0.009 | 0.038 | No cracks |
| 38 | 76 | 9.4 | 0.009 | 0.038 | No cracks |
| 39 | 78 | 8.4 | 0.008 | 0.036 | No cracks |
| 40 | 73 | 8.1 | 0.005 | 0.022 | No cracks |
| 41 | 68 | 6.1 | 0.005 | 0.029 | No cracks |
| 42 | 72 | 7.6 | 0.013 | 0.045 | No cracks |
| 43 | 71 | 8.3 | 0.007 | 0.035 | No cracks |
| 44 | 72 | 9.4 | 0.006 | 0.033 | No cracks |
| 45 | 76 | 8.4 | 0.009 | 0.041 | No cracks |
| 46 | 77 | 8.8 | 0.009 | 0.041 | No cracks |

TABLE 5

| Type | Cr | Mo | Ta | Mg | N | Mn | Si | Fe | Co | Al |
|---|---|---|---|---|---|---|---|---|---|---|
| 1 | 17.9* | 19.3 | 2.1 | 0.006 | 0.016 | 0.053 | 0.010 | 0.24 | 0.12 | 0.35 |
| 2 | 21.1* | 19.1 | 1.5 | 0.010 | 0.014 | 0.033 | 0.014 | 0.29 | 0.78 | 0.28 |
| 3 | 19.4 | 17.9* | 1.7 | 0.013 | 0.018 | 0.039 | 0.026 | 0.35 | 0.55 | 0.14 |
| 4 | 19.0 | 21.1* | 1.6 | 0.016 | 0.012 | 0.027 | 0.021 | 0.16 | 0.34 | 0.39 |
| 5 | 18.9 | 19.6 | 1.0* | 0.014 | 0.009 | 0.035 | 0.017 | 0.14 | 0.25 | 0.21 |
| 6 | 18.7 | 19.8 | 2.6* | 0.009 | 0.017 | 0.033 | 0.011 | 0.23 | 0.17 | 0.16 |
| 7 | 19.2 | 19.2 | 1.7 | —* | 0.013 | 0.041 | 0.018 | 0.35 | 0.39 | 0.11 |
| 8 | 19.0 | 19.3 | 2.2 | 0.053* | 0.011 | 0.028 | 0.026 | 0.31 | 0.76 | 0.18 |
| 9 | 19.5 | 18.8 | 1.6 | 0.032 | —* | 0.033 | 0.021 | 0.22 | 0.50 | 0.26 |
| 10 | 19.9 | 20.3 | 2.0 | 0.038 | 0.044* | 0.041 | 0.015 | 0.17 | 0.19 | 0.20 |

TABLE 5-continued

| | | | | | | | | | | |
|---|---|---|---|---|---|---|---|---|---|---|
| 11 | 20.1 | 18.6 | 1.9 | 0.029 | 0.016 | —* | 0.028 | 0.41 | 0.38 | 0.18 |
| 12 | 19.4 | 19.1 | 1.5 | 0.024 | 0.018 | 0.505* | 0.017 | 0.49 | 0.46 | 0.16 |
| 13 | 19.3 | 18.9 | 1.7 | 0.021 | 0.014 | 0.061 | —* | 0.34 | 0.55 | 0.19 |
| 14 | 19.7 | 18.7 | 1.8 | 0.031 | 0.019 | 0.065 | 0.052* | 0.27 | 0.61 | 0.28 |
| 15 | 18.9 | 19.2 | 1.9 | 0.033 | 0.023 | 0.072 | 0.023 | —* | 0.45 | 0.23 |
| 16 | 18.7 | 19.3 | 2.0 | 0.016 | 0.016 | 0.039 | 0.017 | 1.05* | 0.22 | 0.36 |
| 17 | 19.1 | 19.4 | 1.6 | 0.017 | 0.010 | 0.025 | 0.011 | 0.58 | —* | 0.26 |
| 18 | 19.3 | 18.9 | 1.7 | 0.014 | 0.012 | 0.037 | 0.024 | 0.32 | 1.04* | 0.30 |
| 19 | 19.6 | 19.1 | 1.8 | 0.011 | 0.009 | 0.040 | 0.018 | 0.24 | 0.30 | —* |
| 20 | 19.7 | 19.0 | 1.9 | 0.019 | 0.015 | 0.089 | 0.012 | 0.18 | 0.27 | 0.52* |

(unit: mass %)

| Type | Ti | V | Nb | B | Zr | Cu | W | Ca | Hf | Ni |
|---|---|---|---|---|---|---|---|---|---|---|
| 1 | 0.03 | 0.033 | 0.041 | 0.0024 | 0.011 | — | — | — | — | Balance |
| 2 | 0.06 | 0.045 | 0.015 | 0.0015 | 0.013 | — | — | — | — | Balance |
| 3 | 0.05 | 0.065 | 0.011 | 0.0044 | 0.018 | — | — | — | — | Balance |
| 4 | 0.04 | 0.041 | 0.034 | 0.0021 | 0.021 | — | — | — | — | Balance |
| 5 | 0.05 | 0.036 | 0.021 | 0.0018 | 0.024 | — | — | — | — | Balance |
| 6 | 0.07 | 0.055 | 0.029 | 0.0028 | 0.030 | — | — | — | — | Balance |
| 7 | 0.08 | 0.048 | 0.038 | 0.0033 | 0.015 | — | — | — | — | Balance |
| 8 | 0.05 | 0.037 | 0.045 | 0.0038 | 0.011 | — | — | — | — | Balance |
| 9 | 0.04 | 0.022 | 0.047 | 0.0041 | 0.013 | — | — | — | — | Balance |
| 10 | 0.06 | 0.029 | 0.051 | 0.0018 | 0.011 | — | — | — | — | Balance |
| 11 | 0.05 | 0.018 | 0.043 | 0.0026 | 0.023 | — | — | — | — | Balance |
| 12 | 0.03 | 0.023 | 0.039 | 0.0019 | 0.021 | — | — | — | — | Balance |
| 13 | 0.04 | 0.047 | 0.026 | 0.0026 | 0.028 | — | — | — | — | Balance |
| 14 | 0.04 | 0.040 | 0.024 | 0.0011 | 0.016 | — | — | — | — | Balance |
| 15 | 0.05 | 0.059 | 0.036 | 0.0014 | 0.011 | — | — | — | — | Balance |
| 16 | 0.04 | 0.071 | 0.029 | 0.0034 | 0.015 | — | — | — | — | Balance |
| 17 | 0.06 | 0.064 | 0.022 | 0.0033 | 0.014 | — | — | — | — | Balance |
| 18 | 0.03 | 0.034 | 0.027 | 0.0037 | 0.019 | — | — | — | — | Balance |
| 19 | 0.07 | 0.058 | 0.023 | 0.0045 | 0.022 | — | — | — | — | Balance |
| 20 | 0.09 | 0.078 | 0.017 | 0.0018 | 0.028 | — | — | — | — | Balance |

*indicates that the element deviates from the composition of the present invention.

TABLE 6

| | Hot torsion test | | Corrosion test | | |
|---|---|---|---|---|---|
| Type | Maximum shear stress (MPa) | Number of torsions (times) | Boiling 1% HCl (mm/year) | Boiling 10% $H_2SO_4$ (mm/year) | State after forging in test piece-producing step |
| 1 | 80 | 7.6 | 0.022 | 0.051 | No cracks |
| 2 | 96 | 6.1 | 0.011 | 0.042 | No cracks |
| 3 | 74 | 7.9 | 0.024 | 0.059 | No cracks |
| 4 | 83 | 4.8 | 0.004 | 0.028 | Edge cracks |
| 5 | 74 | 7.6 | 0.028 | 0.068 | No cracks |
| 6 | 86 | 4.5 | 0.007 | 0.038 | Edge cracks |
| 7 | 78 | 7.7 | 0.010 | 0.040 | Edge cracks |
| 8 | 82 | 5.2 | 0.026 | 0.058 | No cracks |
| 9 | 77 | 6.6 | 0.015 | 0.050 | Edge cracks |
| 10 | 84 | 5.8 | 0.007 | 0.036 | Edge cracks |
| 11 | 79 | 5.9 | 0.008 | 0.036 | Edge cracks |
| 12 | 77 | 6.8 | 0.009 | 0.038 | Edge cracks |
| 13 | 77 | 4.4 | 0.012 | 0.044 | No cracks |
| 14 | 78 | 4.7 | 0.010 | 0.039 | No cracks |
| 15 | 79 | 5.3 | 0.006 | 0.032 | Edge cracks |
| 16 | 80 | 7.2 | 0.020 | 0.057 | No cracks |
| 17 | 78 | 5.7 | 0.010 | 0.043 | Edge cracks |
| 18 | 98 | 5.8 | 0.010 | 0.044 | No cracks |
| 19 | 83 | 4.1 | 0.008 | 0.035 | Edge cracks |
| 20 | 99 | 6.4 | 0.005 | 0.031 | No cracks |

TABLE 7

| Type | Cr | Mo | Ta | Mg | N | Mn | Si | Fe | Co | Al | Ti |
|---|---|---|---|---|---|---|---|---|---|---|---|
| 21 | 19.1 | 19.6 | 1.7 | 0.022 | 0.016 | 0.014 | 0.017 | 0.11 | 0.23 | 0.29 | —* |
| 22 | 18.8 | 19.8 | 2.0 | 0.025 | 0.018 | 0.015 | 0.015 | 0.23 | 0.45 | 0.33 | 0.11* |
| 23 | 19.6 | 19.2 | 1.6 | 0.019 | 0.014 | 0.023 | 0.019 | 0.21 | 0.62 | 0.21 | 0.04 |
| 24 | 19.7 | 19.2 | 1.5 | 0.017 | 0.016 | 0.065 | 0.025 | 0.13 | 0.41 | 0.17 | 0.03 |
| 25 | 19.5 | 19.0 | 1.9 | 0.014 | 0.016 | 0.038 | 0.029 | 0.20 | 0.27 | 0.15 | 0.05 |
| 26 | 18.9 | 19.5 | 1.7 | 0.015 | 0.017 | 0.074 | 0.022 | 0.22 | 0.19 | 0.20 | 0.06 |
| 27 | 19.8 | 18.7 | 1.8 | 0.020 | 0.015 | 0.046 | 0.026 | 0.12 | 0.65 | 0.27 | 0.04 |

TABLE 7-continued

| | | | | | | | | | | | |
|---|---|---|---|---|---|---|---|---|---|---|---|
| 28 | 19.5 | 18.9 | 1.9 | 0.009 | 0.011 | 0.034 | 0.014 | 0.38 | 0.31 | 0.31 | 0.08 |
| 29 | 19.6 | 18.8 | 1.6 | 0.007 | 0.010 | 0.041 | 0.009 | 0.29 | 0.33 | 0.37 | 0.06 |
| 30 | 19.7 | 19.3 | 1.5 | 0.018 | 0.009 | 0.015 | 0.006 | 0.21 | 0.47 | 0.17 | 0.07 |

(unit mass %)

| Type | V | Nb | B | Zr | Cu | W | Ca | Hf | Ni |
|---|---|---|---|---|---|---|---|---|---|
| 21 | 0.066 | 0.034 | 0.0022 | 0.020 | — | — | — | — | Balance |
| 22 | 0.060 | 0.041 | 0.0026 | 0.012 | — | — | — | — | Balance |
| 23 | —* | 0.040 | 0.0039 | 0.010 | — | — | — | — | Balance |
| 24 | 0.110* | 0.033 | 0.0022 | 0.014 | — | — | — | — | Balance |
| 25 | 0.054 | —* | 0.0018 | 0.016 | — | — | — | — | Balance |
| 26 | 0.051 | 0.105* | 0.0015 | 0.011 | — | — | — | — | Balance |
| 27 | 0.063 | 0.065 | —* | 0.008 | — | — | — | — | Balance |
| 28 | 0.069 | 0.055 | 0.0106* | 0.019 | — | — | — | — | Balance |
| 29 | 0.071 | 0.058 | 0.0035 | —* | — | — | — | — | Balance |
| 30 | 0.083 | 0.023 | 0.0044 | 0.052* | — | — | — | — | Balance |

*indicates that the element deviates from the composition of the present invention.

TABLE 8

| | Hot torsion test | | Corrosion test | | |
|---|---|---|---|---|---|
| Type | Maximum shear stress (MPa) | Number of torsions (times) | Boiling 1% HCl (mm/year) | Boiling 10% $H_2SO_4$ (mm/year) | State after forging in test piece-producing step |
| 21 | 79 | 4.3 | 0.008 | 0.035 | Edge cracks |
| 22 | 102 | 6.7 | 0.006 | 0.030 | No cracks |
| 23 | 78 | 3.8 | 0.012 | 0.043 | Edge cracks |
| 24 | 77 | 3.4 | 0.013 | 0.046 | Edge cracks |
| 25 | 79 | 3.6 | 0.006 | 0.033 | Edge cracks |
| 26 | 79 | 3.2 | 0.008 | 0.036 | Edge cracks |
| 27 | 78 | 3.4 | 0.010 | 0.040 | Edge cracks |
| 28 | 79 | 4.6 | 0.007 | 0.035 | Edge cracks |
| 29 | 77 | 3.2 | 0.009 | 0.049 | Edge cracks |
| 30 | 78 | 4.1 | 0.010 | 0.046 | Edge cracks |

TABLE 9

| Type | Cr | Mo | Ta | Mg | N | Mn | Si | Fe | Co | Al |
|---|---|---|---|---|---|---|---|---|---|---|
| 1 | 20.4 | 19.1 | 1.88 | 0.0119 | — | 0.2346 | 0.0354 | 0.12 | — | — |
| 2 | 19.2 | 21.1 | 1.93 | 0.0216 | — | 0.2235 | 0.0734 | 3.62 | — | — |
| 3 | 20.1 | 19.7 | 1.72 | — | 0.0006 | 0.0729 | 0.0214 | 0.05 | — | — |

(unit: mass %)

| Type | Ti | V | Nb | B | Zr | Cu | W | Ca | Hf | Ni |
|---|---|---|---|---|---|---|---|---|---|---|
| 1 | — | — | — | — | — | — | — | — | 0.014 | Balance |
| 2 | — | — | 0.12 | 0.004 | 0.001 | 0.13 | 0.15 | — | 0.004 | Balance |
| 3 | — | — | — | 0.003 | — | — | — | — | 0.0058 | Balance |

TABLE 10

| | Hot torsion test | | Corrosion test | | |
|---|---|---|---|---|---|
| Type | Maximum shear stress (MPa) | Number of torsions (times) | Boiling 1% HCl (mm/year) | Boiling 10% $H_2SO_4$ (mm/year) | State after forging in test piece-producing step |
| 1 | 88 | 1.5 | 0.012 | 0.044 | Edge cracks |
| 2 | 93 | 3.4 | 0.014 | 0.043 | Edge cracks |
| 3 | 91 | 3.2 | 0.012 | 0.043 | Edge cracks |

From the results shown in Tables 2, 4, 6, 8, and 10, it was possible to confirm that, compared to the conventional Ni-based alloys 1 to 3 as conventional materials, the corrosion resistance and the deformation resistance at 1250° C. (maximum shear stress) of the Ni-based alloys 1 to 46 of the present invention were at the same level. In addition, it was possible to confirm that, compared to the conventional Ni-based alloys 1 to 3 as conventional materials, the deformability (the number of torsions) at 1250° C. of the Ni-based alloys 1 to 46 of the present invention was particularly significantly improved.

Further, regarding the comparative Ni-based alloys 1 to 30 deviating from the present invention, any of the results that the corrosion resistance was deteriorated, the deformability at 1250° C. (the number of torsions) was small, and the hot forgeability was deteriorated such that cracking occurred in a forging step at 1000° C. or lower for producing the corrosion test piece, compared to the Ni-based alloys 1 to 46 of the present invention, was obtained.

INDUSTRIAL APPLICABILITY

As described above, according to the Ni-based alloy of the present invention, since the hot forgeability can be improved without deteriorating the corrosion resistance, a large structural member can be produced. Since a weld zone can be reduced as much as possible as increasing the size, a portion having deteriorated corrosion resistance can be minimized. Therefore, it is possible to improve the corrosion resistance of the equipment as a whole used in a petrochemical plant, a pharmaceutical intermediate-manufacturing plant, and a pollution control system. In addition, it is possible to reduce the frequency of maintenance. In this manner, the Ni-based alloy of the present invention exhibits excellent industrial effects.

Further, since the Ni-based alloy of the present invention has excellent hot forgeability, a long seamless tube having a large diameter can be easily produced using the Ni-based alloy. Therefore, the Ni-based alloy of the present invention is expected as a new material to be applied to new fields.

The invention claimed is:

1. A Ni-based alloy having improved hot forgeability and corrosion resistance comprising, by mass%:

Cr: more than 18% to less than 21%;
Mo: more than 18% to less than 21%;
Ta: 1.1% to 2.5%;
Mg: 0.001% to 0.05%;
N: 0.001% to 0.04%;
Mn: 0.001% to 0.5%;
Si: 0.001% to 0.05%;
Fe: 0.01% to 1%;
Co: 0.01% or more and less than 1%;
Al: 0.01% to 0.5%;
Ti: 0.01% or more and less than 0.1%;
V: 0.005% or more and less than 0.1%;
Nb: 0.001% or more and less than 0.1%;
B: 0.0001% to 0.01%;
Zr: 0.001% to 0.05%; and
a balance consisting of Ni and unavoidable impurities.

2. The Ni-based alloy having improved hot forgeability and corrosion resistance according to claim 1 further comprising, by mass %, one or more of Cu: 0.001% or more and less than 0.1%, and
W: 0.001% or more and less than 0.1%.

3. The Ni-based alloy having improved hot forgeability and corrosion resistance according to claim 1 further comprising, by mass %, Ca: 0.001% or more and less than 0.05%.

4. The Ni-based alloy having improved hot forgeability and corrosion resistance according to any one of claims 1 further comprising, by mass %, Hf: 0.001% or more and less than 0.05%.

5. A large structural member formed by the Ni-based alloy having improved hot forgeability and corrosion resistance according to claim 1.

6. The Ni-based alloy having improved hot forgeability and corrosion resistance according to claim 1, wherein an amount of Mo is 18.5% to less than 21%.

7. The Ni-based alloy having improved hot forgeability and corrosion resistance according to claim 1, wherein the amount of Ta is 1.5% to 2.5%.

8. The Ni-based alloy having improved hot forgeability and corrosion resistance according to claim 1, wherein an amount of Mo is 18.5% to less than 21% and an amount of Ta is 1.5% to 2.5%.

* * * * *